United States Patent [19]

Anfruns

[11] 3,967,390

[45] July 6, 1976

[54] SHOE

[76] Inventor: Luis Sentis Anfruns, Panama St. 2&4, Barcelona, Spain

[22] Filed: Mar. 6, 1975

[21] Appl. No.: 556,122

[30] Foreign Application Priority Data

May 8, 1974 Spain ..... 202,922[U]

[52] U.S. Cl. ..... 36/94; 2/239

[51] Int. Cl.[2] ..... A43B 17/00

[58] Field of Search ..... 36/1, 2.5 R, 11, 11.5, 36/45; 2/239, 240, 241

[56] References Cited

UNITED STATES PATENTS

| | | | |
|---|---|---|---|
| 35,629 | 6/1962 | Rosenheimer | 36/2.5 R |
| 1,308,483 | 7/1919 | Craighead | 2/239 |
| 3,013,564 | 12/1961 | Levey | 2/241 |
| 3,128,763 | 4/1964 | Langenfeld et al. | 2/239 |

*Primary Examiner*—Patrick D. Lawson
*Attorney, Agent, or Firm*—Robert E. Burns; Emmanuel J. Lobato; Bruce L. Adams

[57] ABSTRACT

A shoe or stocking has a tip portion which consists of five toe compartments. In each toe compartment a flexible side and front wall interconnects a part of the sole with a part of the upper.

5 Claims, 6 Drawing Figures

FIG. 1
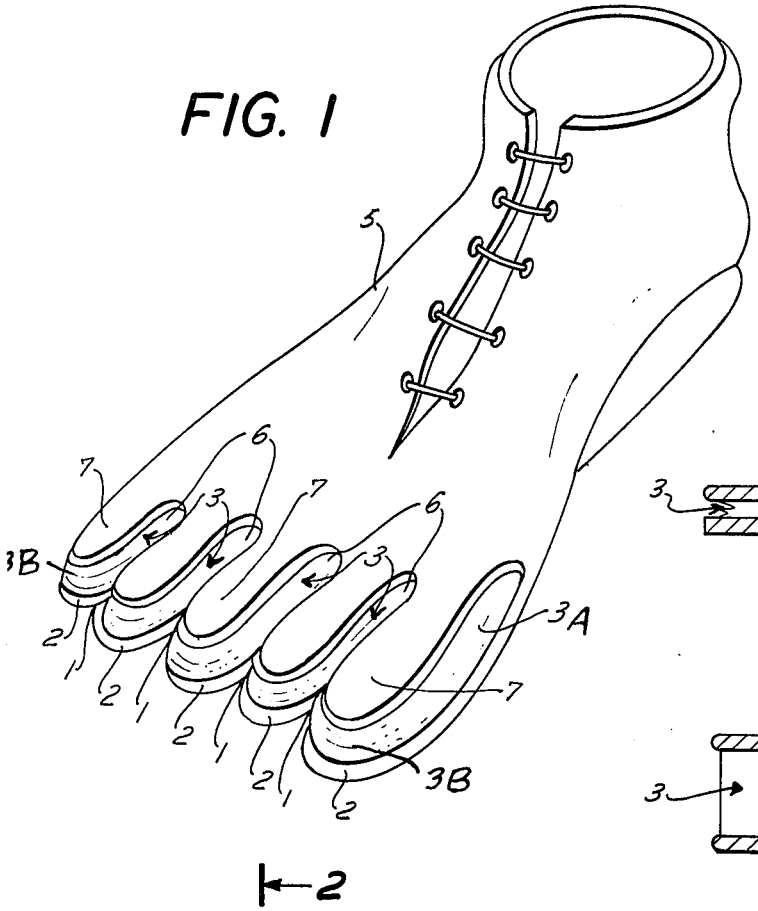
FIG. 2
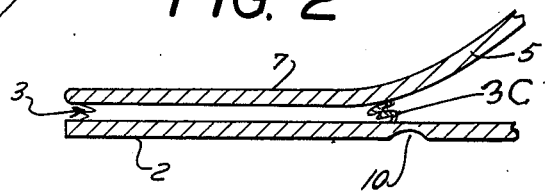
FIG. 3
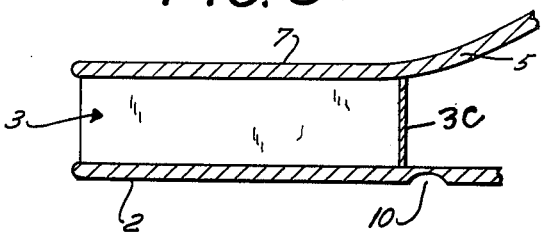
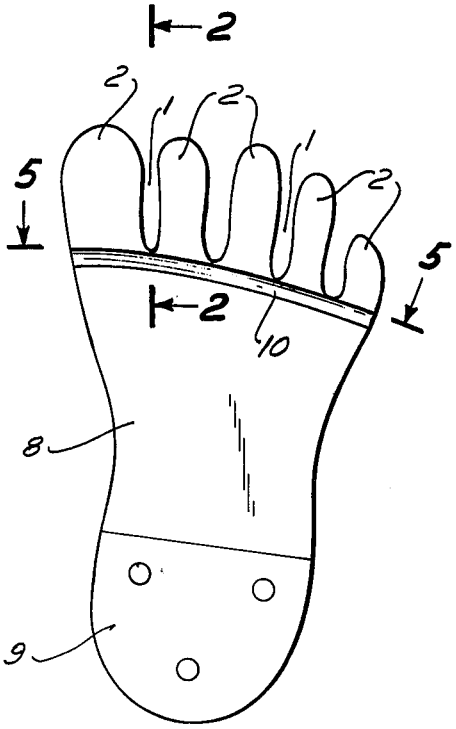
FIG. 4
FIG. 5
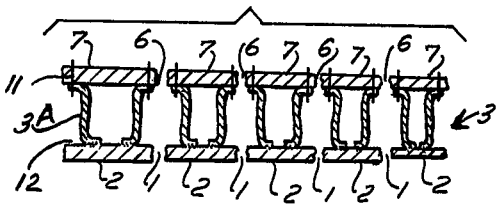
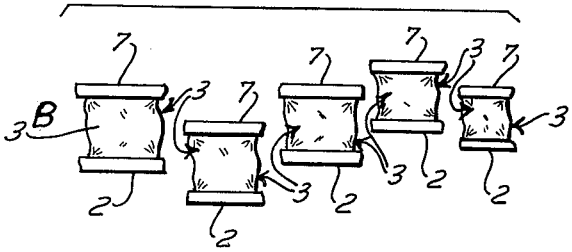
FIG. 6

SHOE

BACKGROUND OF THE INVENTION

This invention relates to shoes and stockings provided with separate toe compartments.

Footwear of this type is available now. It prevents mutual separation of the toes, to avoid pressing the toes together. This construction of footwear is desirable for avoiding harm to the bone structure of the foot. It also provides most effective engagement of the ground, by the feet. However the advantages of this type of footwear have not been fully obtained, thus far. A number of drawbacks have been encountered.

For example in such a shoe, as made until now, difficulties were encountered as the tip or fore-part of the upper is made of a single piece of material, having toe elements shaped to provide the toe compartments and having edges attached to the corresponding elements. As a result, these elements reenforce one another, and the toe compartments therefore have considerable stiffness. When the user of such a shoe or stocking stands or walks on irregular ground his toes are not as fully independent of one another, and not as firmly in contact with the ground, as they should be. The sole portions tend to be held on a single level.

It is desirable to provide more fully separated and independent sole portions, one for each toe compartment. Only thereby can the wearer's toes adjust themselves to the ground in truly separate and independent fashion. This was impossible thus far, even with footwear having separate toe compartments. Only a small part of the desirable individual adaptation of the toes to the ground was actually obtained. In some instances the wearer was not even able to stand firmly on the ground.

Moreover the conventional shoe tips with separate toe compartments have toe-separating walls which are made of relatively still and rigid material. Due to such construction the sides of each toe compartment rub against the delicate skin of the toe. This condition tends to produce blisters.

Also, as the conventional toe compartments are relatively stiff and rigid, it is inconvenient and difficult to insert the toes into these respective compartments. Little or no use can be made of the fingers, for this purpose, because of the stiffness and rigidity of the compartments.

OBJECTS AND NATURE OF THE INVENTION

It is an object of the invention to provide foot-wear of the indicated type which is free of these inconveniences, troubles and drawbacks.

It is another object of the invention to provide a shoe of the indicated type with improved adaptation of each toe to the ground surface.

Still another object is to provide truly separate and flexible toe compartments, while preferably using a relativey stiff sole element for each toe compartment.

For these purposes a shoe according to the invention has separate toe compartments which have walls of flexible material, between corresponding parts of the sole and of the upper.

By this construction the different toe compartments are enabled to flex independently of one another and of the other parts of the shoe. This remains true even if the shoe and its toe compartments have a fairly stiff sole. Moreover the sole elements can be parts of a single, stiff sole, partly separated from and hinged to the remainder of the sole by a suitable cut or recess. The flexible nature of the side walls allows each toe compartment of the new shoe to find its own, independent contact with uneven portions of the ground. The new construction also provides toe compartments which adapt themselves to very different width and thickness dimensions of the toes of different wearers. Still further the new footwear avoids rubbing of shoe leather against the toes, when different toes, in different toe compartments, differently adjust themselves to the ground. Briefly, the new construction provides improved stance of the wearer, on the ground, wider range of use of shoes of a given size, and better protection against painful and harmful rubbing of the toes against the shoe.

BRIEF DESCRIPTION OF THE DRAWINGS

FIG. 1 is a perspective review of a preferred embodiment of a shoe incorporating the new construction.

FIG. 2 is the sectional detail view taken along lines 2—2 in FIG. 4.

FIG. 3 is a view similar to FIG. 2 but showing a different position of parts of the illustrated structure.

FIG. 4 is a bottom view of the shoe.

FIG. 5 is a sectional view taken along lines 5—5 in FIG. 4 and

FIG. 6 is a fron view of the forepart of the shoe.

DESCRIPTION OF THE PREFERRED EMBODIMENT

The forepart of the new shoe comprises five separate toe compartments. Between every two such compartments an intermediate space 1 separates portions 2 of the shoe sole from one another. Each toe compartment has a separate portion 7 of the upper at its top, and separations 10 are provided between these upper portions 7. According to the invention the portions 2 and 7 are interconnected by flexible walls 3. A single strip of flexible material can be provided for the entire shoe. This flexible strip can extend from one side of the tip of the shoe around and between the toe compartments to the other side of the tip of the shoe. Separate sections of the flexible strip can thereby provide the side and front walls 3A and 3B, respectively, of each toe compartment, and the innerconnecting walls 3C.

Each toe compartment, as shown, has a sole portion 2, integral with a shoe sole 8. The sole 8 is shown as having a heel 9 thereon. The sole is generally, marginally secured to the upper, as usual. The separate portions 7 of the upper are integral with the piece of leather constituting the upper 5 of the shoe in general.

A score line, cut, recess or indentation 10 is shown as upwardly extending into the sole 8, between the sole portions 2 and the remainder of the sole, to promote flexing of the separate toe compartments 2, 3, 7 whenever such flexing is required in the use of the shoe.

The flexible walls 3 of the toe compartments 2, 3, 7 can be made of different materials, known by themselves. The selection of such materials depends on whether the shoe is intended for more or less heavy duty and for more or less delicate feet. The selection of specific materials depends for example on whether the shoe is to be worn in the winter, or in rainy weather, when the feet must generally be protected from cold and moisture. If the shoes are to be worn in the summer it may be preferred to use permeable material for walls 3, to ventilate the shoes. It is preferred to use a shoe sole 8 of strong, natural leather or synthetic plastic material. It is further preferred to use soft side and front walls 3A and 3B, respectively, made for example of sheep skin, for the toe compartments 2, 3, 7. The uppers 5 including their toe portions 7 can be made for example of kid leather or the like. Wall portions 3 may be secured to upper and sole portions 7, 2 by various techniques, for example by stitching 11 and glueing 12 respectively.

For shipment and storage of the shoes, the forepart of each shoe may be in the condition illustrated in FIG. 2. In this condition the toe compartments are substantially collapsed. Their side and front walls 3A and 3B, respectively, are folded, and the sole and upper portions 2, 7 are almost or actually, in contact with one another.

In the use of the shoe, on insertion of the wearer's foot, the arrangement of the same part more or less approaches the condition illustrated in FIG. 3. Here the toe compartments 2, 3, 7 are expanded. Sole and upper portions 2, 7 are spaced apart, to suit the thickness of the user's toes.

Adjacent the inner ends of the toe-separating cutouts 1, as shown in FIG,. 5, the several toe compartments 2, 3, 7 are held at approximately the same level, by the relative stiffness of the sole 8. By contrast, the forward portions of the toe compartments of the new shoe, as best shown in FIG. 6, are relatively free to adapt themselves to different levels of the ground, as a result of their flexible construction, provided by the flexible front walls 3. The sole portions 2 are free to shift forward and backwardly, as well as laterally relative to the upper portions 7 to such extent as to allow the different toe compartments to find their positions separately and independently. By virtue of this feature the stance of the wearer of the new shoe, on regular or irregular ground, is greatly improved.

At the same time the putting on of the shoe is also improved. The toes are more easily inserted in the new relatively independent toe compartments 2, 3, 7. Additionally, the use of soft and flexible side walls 3 and the new and improved independent the toe compartments 2, 3, 7 minimizes harmful and painful rubbing of the toes against the shoe leather.

I claim:

1. A shoe comprising; a relatively rigid sole; a relatively flexible upper generally marginally secured to said sole; both said sole and said upper having tip portions defining five toe compartments separate from one another; and flexible wall means interconnecting the tip portions of the relatively flexible upper with the tip portions of the relatively rigid sole, comprising flexible side walls of each toe compartment, and four flexible walls, one between every two of the toe compartments, to enable the separate toe compartments to flex independently of one another and of the remainder of the sole and upper.

2. A shoe comprising; a relatively stiff sole; an upper, generally marginally secured to said sole; both said sole and said upper having tip portions defining toe compartments separate from one another; and said sole having a recess upwardly extending into the same between the toe compartments and the remainder of the sole to enable the several tip portions of the sole and the respective toe compartments to flex independently of one another and of the remainder of the sole.

3. A shoe comprising; a sole; an upper generally marginally secured to said sole, both said sole and said upper having tip portions defining five toe compartments separate from one another, the sole being relatively stiff but having a recess upwardly extending into the same between the toe compartments and the remainder of the sole to define hinge portions, one for each toe compartment; anf flexible wall means interconnecting the tip portions of the upper with the tip portions of the sole, comprising a flexible front wall of each toe compartment and a flexible wall between every two of the toe compartments to enable the separate toe compartments to flex independently of one another and of the remainder of the sole and upper.

4. A shoe according to claim 2 including a relatively flexible wall member interposed between the tip portions of the upper and those of the sole and marginally secured to said tip portions

5. A shoe comprising; a generally flat and relatively stiff sole; a relatively flexible upper generally marginally directly connected to said sole; both said sole and said upper having tip portions defining five toe compartments separate from one another; and a flexible strip extending around each and between every two of the toe compartments and interconnecting the tip portions of the upper with the tip portions of the sole.

* * * * *